US007399218B2

(12) United States Patent
Witter

(10) Patent No.: US 7,399,218 B2
(45) Date of Patent: Jul. 15, 2008

(54) RIDE-ON FLOOR MACHINE WITH DUST COLLECTION SYSTEM

(76) Inventor: Robert M. Witter, 150 Robineau Rd., Syracuse, NY (US) 13207

( * ) Notice: Subject to any disclaimer, the term of this patent is extended or adjusted under 35 U.S.C. 154(b) by 0 days.

(21) Appl. No.: 11/475,452

(22) Filed: Jun. 27, 2006

(65) Prior Publication Data

US 2007/0298695 A1 Dec. 27, 2007

(51) Int. Cl.
*B24B 23/00* (2006.01)

(52) U.S. Cl. ..... 451/353; 451/453; 451/456

(58) Field of Classification Search ..... 451/350–359, 451/451–457

See application file for complete search history.

(56) References Cited

U.S. PATENT DOCUMENTS 4,654,918 A * 4/1987 Cooper ..... 15/98
5,092,658 A * 3/1992 Smith ..... 299/39.4
RE34,822 E 1/1995 Mattson
6,295,682 B1 * 10/2001 Klucznik ..... 15/50.1
6,419,565 B2 7/2002 Mattson et al.
6,450,867 B1 * 9/2002 Legatt ..... 451/350
6,833,016 B2 12/2004 Witter
6,986,397 B2 1/2006 Mattson et al.
2007/0155285 A1 * 7/2007 Padgett et al. ..... 451/5

* cited by examiner

*Primary Examiner*—Dung Van Nguyen
(74) *Attorney, Agent, or Firm*—Bernhard P. Molldrem, Jr.

(57) ABSTRACT

A riding floor sander for large hardwood floor surfaces, such as gymnasiums and dance floors, has a powered cart with one or more sanding machines connected to it. A blower picks up the process waste in a stream of air and and moves it to a cyclone separator that is mounted on the riding sanding machine. There the dust is separated from the air stream, leaving clean air to be returned to the ambient. The dust that falls from the cyclone into a dust collection drum or bag on the cart. There can be are primary cyclonic separators on the sanding machines, and a cyclonic separator on the back of the riding cart. Alternatively, the cyclone and drum may be located remote from the riding sander, and can have an in-line auxiliary pump or impeller.

5 Claims, 1 Drawing Sheet

RIDE-ON FLOOR MACHINE WITH DUST COLLECTION SYSTEM

BACKGROUND OF THE INVENTION

This invention is directed to a power riding device for sanding and preparing large floor surfaces, such as gymnasium floors and dance floors. The invention is more particularly concerned with power floor sanding equipment that incorporates a cart on which the operator rides, and which propels the floor sanding machine along the floor surface. The invention is more specifically directed to a riding floor sanding machine that incorporates a facility for controlling the dust that is generated from the floor sanding operation.

The problem of sanding and refinishing large floor areas, such as gymnasium floors, dance floors, or similar large hardwood surfaces, has been discussed, for example, in U.S. Pat. Nos. Re. 34,822 and 6,986,397. Similar arrangements are presented in U.S. Pat. Nos. 6,419,565 and 6,202,775. Each of these proposes a powered vehicle, e.g., a cart or trailer, with one or more power floor sanders or equivalent floor finishing devices incorporated into it or attached to it at the front. The cart has a seat for an operator and power controls so that the operator can regulate the speed of the vehicle. The operator steers the assembly by means of the handle or handles on the floor sanding machine. This arrangement has made it possible to increase the speed and efficiency for sanding these large hardwood surfaces in preparation for refinishing them. However, the arrangements as described in these patents employ simple fabric dust bags attached onto the dust exhaust pipes that rise from the sander machine(s). These have a problem of filling very quickly, which means having to stop the operation frequently to empty them. These dust collection bags are notoriously poor filters, and leak out much of the fine dust particles that the sander machines generate. Consequently, the room in which the hardwood floor is located becomes a dusty environment, causing health problems for the workers and also creating a layer of dust on the floor that demands a significant cleaning effort later on. Also, the fine wood dust particles are quite flammable, and can create a fire hazard around the floor sander machines.

The bag will tend to inflate as the exhaust air and the dust flow into it, and this presents a vision problem for the operator, as it obstructs the view in the direction the floor sander and cart are traveling.

It would be desirable to collect bulk solids, such as wood dust, inside a drum or barrel, instead of collecting the dust in cloth bags and then transferring it later on. However, no one has proposed any sort of mechanism for depositing the wood dust that is generated from a ride-on floor sander directly into a container so as to minimize or eliminate airborne dust in the gymnasium, ballroom or other location where the hardwood floor is being prepared for finishing.

OBJECTS AND SUMMARY OF THE INVENTION

Accordingly, it is an object of this invention to provide a riding floor sanding arrangement with an efficient dust collection system so as to avoid the drawbacks of the prior art.

It is a more specific object to provide the cart of a ride-on floor sanding machine with dust collection system in which a dust collection facility, e.g., a drum or a flexible bag (e.g., poly film) supported on a frame or cage, is carried behind the seat of the cart.

It is a further object of this invention to provide a dust collection system that deposits all or nearly all the dust into the drum or flexible bag and cleans the air stream so it can be returned to the ambient.

It is a related object to provide the ride-on floor sanding arrangement with dust collection mechanism that avoids obstructing the operator's view during the floor sanding operation.

According to an aspect of the invention, a riding floor sanding arrangement for sanding a large wood floor surface, employs a ride-on cart, e.g., a trailer, sulky, wagon, or similar vehicle, having a front end and a rear end. A seat is provided on the cart, and the operator is seated there to ride the equipment. The car has a driven wheel or a set of wheels for propelling the cart, and an electric motor and transmission that serve as power source providing power to driven wheel or wheels. There is a control lever and/or foot pedal that allowing the operator to control speed and direction (forward/reverse) of said cart. The operator can steer the assembly via the grips on the floor sanding machine or machines.

The floor sanding machine (or plural machines) is (are) coupled to the front end of the cart, and are pushed forward when the cart travels. The sanding machines each have drum, belt, disk, or similar sanding face that contacts the floor and abrades the wood floor surface. An exhaust duct rises from the body of the sanding machine, and an internal blower in the sanding machine draws in the waste wood dust, and then creates an exhaust stream of air. This air stream entrains the dust that results from the abrading of said floor surface and then directs the air and entrained dust out through the exhaust duct.

In one preferred embodiment a drum or equivalent dust receptacle is carried on the cart behind the operator's seat. A flexible hose has one end connected to the exhaust duct of the sanding machine and a second end leading to a cyclonic separator, the latter being mounted at the rear of the cart above the drum or other dust receptacle. The cyclonic separator has an air inlet connected to the second end the hose, an cone-shaped cyclonic chamber in which the dust is separated out from said air stream. The dust falls into the drum or other dust receptacle while the stream of air continues to a filter arrangement in which the air is filtered and returned into the ambient as clean filtered air.

A vertical vortex pipe within the conic chamber passes out through the top, and it is through this vertical pipe that the separated air exits through the filter.

In some embodiments, there can be a roller supporting the drum on the floor surface behind the cart. Also, a booster pump can be interposed in the flexible hose.

In other preferred embodiments, there may be a primary cyclonic separator interposed between the exhaust duct of the floor sanding machine and to first end of said flexible hose. This has the effect of concentrating the wood dust so that less energy is needed to transport the dust to the drum or collection bag at the back of the cart. This arrangement can be similar to what is shown in my earlier U.S. Pat. No. 6,833,016. The primary cyclonic separator includes a conic chamber: An inlet tube connects to the exhaust duct; a dust outlet at a nose of the conic chamber connects to the first end of said flexible hose; and the separated air passes out an air outlet, where a filter cleans the air and returns the clean air to the ambient.

In another riding floor sanding arrangement for sanding a large wood floor surface, the dust receptacle is situated at a location remote from said cart off the floor surface being sanded, that is off the hardwood being sanded, or at least off that part of the floor surface where the ride-on sanding operation is taking place. An elongated flexible hose has its one end connected to the exhaust duct of the sanding machine and has its second end connected to a cyclonic separator that is mounted at above the drum or other dust receptacle at that remote location. The cyclonic separator acts to separate out the dust from the stream of air; the dust falls into the drum or other dust receptacle while the stream of air continues to a filter arrangement in which the air is filtered and returned into the ambient as clean filtered air.

A booster pump interposed in-line in the elongated flexible hose can be used to advantage here to facilitate transport of the air stream and entrained wood dust to the remote location. Also, primary cyclonic separator or separators on exhaust ducts of the floor sanding machines can be used, which permits a smaller diameter hose to be used to carry the wood dust to the remote dust collection location.

The above and many other objects, features, and advantages of this invention will become apparent from the ensuing detailed description of the preferred embodiments, which is illustrated in the accompanying Drawing.

DETAILED DESCRIPTION OF A PREFERRED EMBODIMENT

Figure 1:
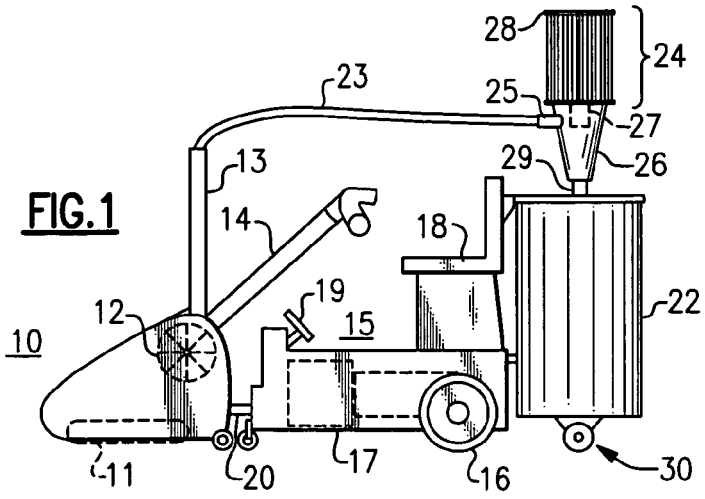
FIG. 1 is a side elevational view of a riding floor sanding arrangement incorporating a dust collection system according to one embodiment of this invention.

Now with reference to the Drawing, FIG. 1 shows ride-on floor sanding arrangement, which incorporates a dust collection system according to an embodiment of this invention in which dust is separated from the air flow, the air is cleaned and returned to the ambient, and the process dust is deposited in a dust collection drum or similar receptacle. Here, the dust collection drum is carried on the ride-on assembly. A floor sanding machine 10 has a sanding belt or disk 11 that contacts the floor surface, and also has a built-in exhaust blower 12 that vacuums up any sanding dust produced and discharges it up an exhaust conduit or pipe 13, which may be adjacent a steering and control handle 14. A powered riding cart 15 has a set of wheels 16, of which one or more receive power from a motor and drive train 17. A seat 18 is provided for the operator, as are one or more foot pedals 19 to control engine speed, and may include a brake and/or clutch pedal. A linkage 20 couples the floor sanding machine 10 to the front end of the cart 15, with the handle 14 of the machine in a position to permit the operator to hold the same by its grips and to steer the same as well as manage the operation of the sanding machine.

A dust collection drum or barrel 22 is mounted at the rear of the cart 15 behind the operator, in this case with fittings to secure it to the body of the cart and to the rear of the seat. A flexible vacuum hose 23 extends from the exhaust end of the pipe 13 rearward to a cyclonic separator 24 that is situated atop the drum 22 to separate out the process dust from the air stream provided by the sanding machine blower 12. The separator 24 deposits the dust into the drum 22 and then cleans and returns the air to the ambient. In this embodiment, the cyclonic separator has an inlet pipe 25 that receives the end of the hose 23 and injects the air stream and entrained dust into a conic cyclone chamber 26. The air stream proceeds around the inside of this chamber 26 and passes up a vertical pipe 27, where it is cleaned by a cartridge filter 28 and exhausted into the ambient air. At the lower end or nose of the conic chamber 26 a conduit 29 passes downward through a lid of the drum 22, and allows the separated dust to precipitate into the drum. The lid should be more or less airtight on the drum so that the collected dust does not blow out from the drum. In this embodiment, an auxiliary wheel 30, e.g., a roller or caster, is shown at the base of the drum 22 to help support the same and permit it to roll along on the floor behind the cart.

Figure 2:
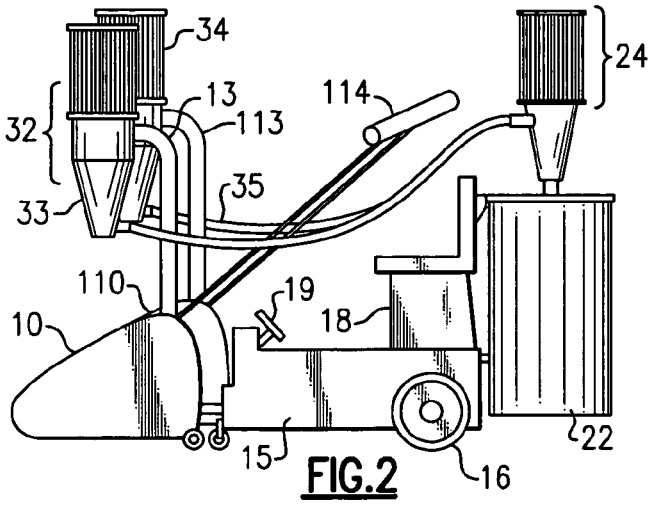
FIG. 2 is a side elevational view showing another possible embodiment.

Another possible embodiment is shown in FIG. 2. Here there are two sanding machines 10 and 110 joined by a linkage 20 to the cart 15. This arrangement permits a double width zone of the hardwood floor to be sanded at each pass. A combined control handle 114 permits the operator to steer and control operation of both sanding machines 10 and 110.

In this embodiment, each sanding machine has a primary cyclonic separator arrangement 32 situated at the upper end of the respective dust exhaust pipe 13, 113. The primary separator arrangements each have a conic chamber 33 into which the air stream flows from the pipe 13 or 113, and a fitting at its lower nose to which front ends of a Y-configured vacuum hose 35 are fitted. There are two intake ends of this hose 35, which join together behind the operator's seat 18, so that the combined hose has one exhaust end that feeds into the inlet pipe 25 of the main cyclonic separator 24, so that the process dust is deposited into the drum 22. Each of the primary cyclonic separator arrangements 32 has a filter cartridge 34 seated atop the conic chamber and over the exhaust pipe of the separator, so that a majority of the air stream from the sanding machine 10 or 110 is cleaned and returned to the ambient at the primary separator. A smaller portion of the air stream passes out the nose of the conic chamber 33 and transports the separated dust to the main cyclonic separator 24 and the drum 22. An auxiliary air pump or booster pump, of the type discussed below, may optionally be interposed in the hose 35 to facilitate transport of the dust.

Figure 2A:
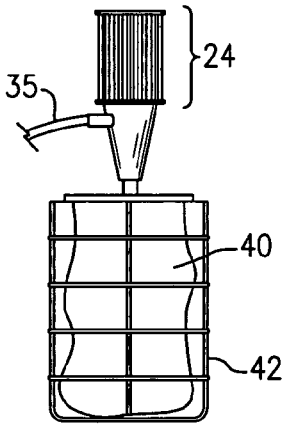
FIG. 2A shows a variation of a portion of the FIG. 2 embodiment.

As shown in FIG. 2A, instead of the rigid-wall collection drum 22, a polyfilm flexible bag 40 may be used as the repository for the dust that precipitates from the main cyclonic separator 24. In this case, a frame or cage 42 may be provided, and this cage 42 can be mounted onto the cart 15 in a similar fashion to what is shown in FIGS. 1 and 2. The bag 40 is situated inside the cage 42, so that the latter supports and contains the bag during the dust collection process.

Figure 3:
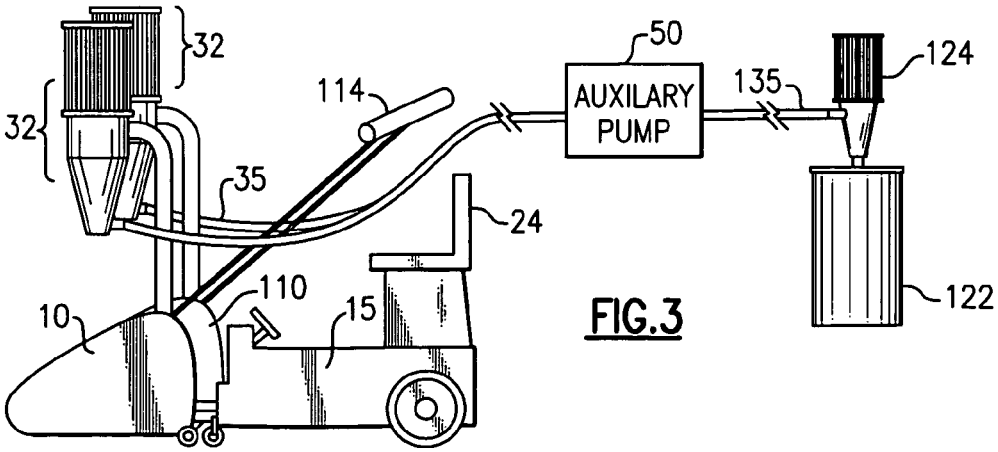
FIG. 3 is a side view of another embodiment.

In another embodiment, as shown in FIG. 3, the main cyclonic separator 124 for separating the dust from the exhaust air stream, as well as the associated dust collection drum 122, can be located at a position remote from the cart 15 and the sanding machines 10, 110. That is, the separator 124 and drum 122 can be situated away from the gymnasium floor or dance floor, or at least away from the portion of the floor that is to be prepared and resurfaced. In this embodiment, the primary cyclonic separators 32, 32 are employed on the sanding machine dust exhaust pipes 13, 113, as described in respect to the FIG. 2 embodiment. However, here the vacuum hose 35 has an extension portion 135 that reaches from the sanding machines and cart out to the location of the separator 124 and drum 122. This hose extension portion may be bundled with the power cord (not shown) that provides electrical power to the floor sanding machines 10, 110 and to the motor 17 for the cart 15. An optional auxiliary air pump or booster pump 50 may be interposed in-line in the hose 35 or 135 to ensure sufficient air flow for the dust to be transported to the remote site of the separator 124 and drum 122. The booster pump, if used, may be positioned on the cart 15 or may be located at a convenient position remote from the cart.

In the described embodiments, the dust collection drum 22 is shown with a flat base and top and a cylindrical side wall However, any other suitable container could be substituted, which need not have a circular or cylindrical shape.

If a rigid drum is used, a bag or liner, favorably is formed of a polyethylene film may be situated within the drum. Different size drums or barrels may be interchanged to accommodate the scope of the project and the volume of waste material to be collected.

In the foregoing embodiments, the floor sanding machines 10, 110 are separate from the carts 15. However, in other possible embodiments, the floor sander(s) can be unitary with the cart, and incorporated into it. Also, rotary sanders, e.g., buffers, can be used instead of the belt or drum sanders, depending on the specific application.

With the dust collection system as shown incorporated into the ride-on floor sanding equipment, there is little or no clean-up required to sweep and vacuum the wood dust, as it is almost entirely transferred into the dust collection barrels or drums 22. At the same time, the air in the gymnasium or dance hall environment is kept clean and dust free during the floor preparation and refinishing operation, thus avoiding health and fire hazards. The drum or barrel can be emptied later without contaminating the ambient air in the building.

While the invention has been described hereinabove with reference to a few preferred embodiments, it should be apparent that the invention is not limited to such embodiments. Rather, many variations would be apparent to persons of skill in the art without departing from the scope and spirit of this invention, as defined in the appended Claims.

I claim:

1. A riding floor sanding arrangement for sanding a large wood floor surface, comprising;

a cart having a front end and a rear end, including a seat on which an operator rides, one or more driven wheels for propelling the cart, a power source providing power to said one or more driven wheels, and means allowing the operator to control speed and direction of said cart;

a drum or belt floor sanding machine at the front end of the cart, the sanding machine having a sanding face contacting and abrading the wood floor surface and generating wood dust, an exhaust duct rising from said sanding machine, and a blower within said sanding machine for creating an exhaust airflow that entrains the wood dust resulting from the abrading of said floor surface and for directing same through said exhaust duct;

a dust receptacle carried on and supported on said cart at a position behind said seat;

a cyclonic separator mounted directly atop said dust receptacle on said cart, including an air inlet, a conic chamber receiving said airflow from said air inlet, with a nose end at a bottom thereof: a dust outlet at said nose end; a vortex tube at an upper end and extending from within said chamber, the vortex tube serving as an air outlet; and a lid onto which the nose end of said conic chamber is mounted, said lid being positioned on said receptacle and making an airtight seal therewith; such that the cyclonic separator acts to separate out the dust from said airstream and the dust falls out said dust outlet into said dust receptacle while the airstream exits through said vortex tube and out the air outlet of said cyclonic separator, and such that the collected dust does not blow out from said receptacle;

a filter arrangement mounted on said cyclonic separator and in which the air that exits said air outlet is filtered and returned into the ambient as clean filtered air; and a flexible hose extending from a first end connected to the exhaust duct of said sanding machine to a second end connected to the air inlet of said cyclonic separator, without an additional blower to move said airstream, such that the floor sanding machine blower alone provides sufficient airflow into the cyclonic separator for separation of the dust from the airstream for separation of the dust from the airstream.

2. The riding floor sanding arrangement according to claim 1 wherein said filter arrangement includes an air filter cartridge disposed over said vortex tube to filter the air exhausted therefrom.

3. The riding floor sanding arrangement according to claim 1 wherein said dust receptacle includes a rigid drum mounted at the rear of said cart.

4. The riding floor sanding arrangement according to claim 3 further including at least one roller supporting said drum on the floor surface.

5. The riding floor sanding arrangement according to claim 1 wherein said dust receptacle includes a flexible film bag, and a support cage mounted at the rear end of said cart for supporting said bag.

* * * * *